US007064534B2

(12) United States Patent
McClure et al.

(10) Patent No.: US 7,064,534 B2
(45) Date of Patent: Jun. 20, 2006

(54) REGULATOR CIRCUITRY AND METHOD

(75) Inventors: David C. McClure, Carrollton, TX (US); Mehdi Zamanian, Carrollton, TX (US)

(73) Assignee: STMicroelectronics, Inc., Carrollton, TX (US)

( * ) Notice: Subject to any disclaimer, the term of this patent is extended or adjusted under 35 U.S.C. 154(b) by 178 days.

(21) Appl. No.: 10/695,294

(22) Filed: Oct. 27, 2003

(65) Prior Publication Data

US 2005/0088152 A1 Apr. 28, 2005

(51) Int. Cl.
*G05F 3/16* (2006.01)

(52) U.S. Cl. ..... 323/314; 307/64; 307/80; 323/299

(58) Field of Classification Search ..... 323/265, 323/268, 273, 274, 303, 299, 311, 312, 313, 323/314, 315; 307/64–66, 80, 82

See application file for complete search history.

(56) References Cited

U.S. PATENT DOCUMENTS 6,031,363 A * 2/2000 Danstrom et al. ..... 323/273
6,404,076 B1 * 6/2002 Matsuda et al. ..... 307/80

* cited by examiner

*Primary Examiner*—Gary L Laxton
(74) *Attorney, Agent, or Firm*—Lisa K. Jorgenson; Andre M. Szuwalski

(57) ABSTRACT

A regulator circuit and method are disclosed for a system. The regulator circuit may include a compare circuit for comparing a first supply voltage to a predetermined voltage level and generating an enable signal based upon the comparison. A selectively enabled voltage regulator is adapted to make available a predetermined current level at a regulated voltage when enabled by the compare circuit. When disabled, the voltage regulator circuit is prohibited from providing current. The voltage regulator may include an output transistor that is normally biased in a saturation mode of operation and is deactivated by the enable signal. By controlling the output transistor based upon the output of the compare circuit, the need for a relatively large transistor for connecting to the first supply voltage is eliminated.

21 Claims, 2 Drawing Sheets

REGULATOR CIRCUITRY AND METHOD

BACKGROUND OF THE INVENTION

1. Technical Field of the Invention

The present invention relates to voltage regulation, and particularly to a circuit and method for making available within a system a current at a regulated voltage.

2. Description of the Related Art

It is known for some electronics-based systems to include a backup battery. In such systems, the battery backup is utilized for providing power to circuits in the system when the main power supply fails to exceed a minimum operating supply voltage level. By providing the backup battery in this way, information stored in the system in a volatile manner may be maintained without experiencing data corruption. In order to prolong battery life, the current drawn by some systems is substantially reduced relative to the current drawn during a normal mode of operation.

Typically, systems having two power supplies, such as a system having both a main power supply for normal operation as well as a backup battery, are connected to each power supply by a distinct transistor or group of transistors. Each transistor is activated depending upon whether the corresponding power supply is to be connected and provide power to the system circuits. In a system having a backup battery, the transistor associated with the main power supply may be quite large depending upon the amount of current that may be drawn by the system circuits.

Voltage regulators are known for receiving a supply voltage at a first level and providing at an output a supply voltage that is stepped-down from or less than the first level. It is difficult to design a voltage regulator for systems having multiple power supplies, because voltage regulators do not necessarily perform sufficiently well in both the normal (higher current draw) and battery backup (lower current draw) modes of operation. In the normal mode of operation, a voltage regulator should have relatively low output impedance with high current sourcing capability. In the battery backup mode of operation, the voltage regulator should have low current.

Based upon the foregoing, there is a need for an improved voltage regulator for a system having multiple power supplies.

SUMMARY OF THE INVENTION

Exemplary embodiments of the present invention overcome shortcomings in prior regulator circuits and satisfy a significant need for regulator circuitry that effectively provides current to a system or circuit at one or more regulated voltage levels. In a first exemplary embodiment of the present invention, the system or circuit has two supplies, such as a conventional voltage supply and a backup battery. The regulator circuitry may include a first voltage regulator adapted to provide power to the system or circuit during the normal mode of operation. The first voltage regulator may have a supply input, an enable input and a supply output. The first voltage regulator may receive at the supply input thereof a supply voltage from a first supply, make available at the supply output a regulated voltage at up to a first predetermined current level when enabled, and provide substantially no current when disabled. A compare circuit may compare the supply voltage of the first supply to a predetermined voltage level and generate a compare output signal having a value representative of the comparison. The compare output signal may be coupled to the enable input of the first voltage regulator. In the event the supply voltage is greater than the predetermined voltage level, the compare output enables the first voltage regulator to make available at its supply output up to the first predetermined current level at a regulated voltage level. Conversely, in the event the supply voltage is less than the predetermined voltage level, the compare output signal disables the first voltage regulator so that a second supply, such as a backup battery, may serve as the power source for the system or circuit.

Instead of using a large transistor coupled between the first supply and the system or circuit for providing an unregulated voltage thereto, the first voltage regulator may include a drive transistor coupled to the output thereof, and bias circuitry for biasing the output transistor so that the output voltage is at the desired regulated voltage and that up to the first predetermined current level is provided to the system or circuit. The first voltage regulator may include an enable transistor coupled to the control terminal of the drive transistor, for selectively deactivating the drive transistor from conducting current based upon the output of the compare circuit.

In a second exemplary embodiment of the present invention, the regulator circuitry includes a second voltage regulator having a supply input and a supply output coupled to the supply output of the first voltage regulator. When the first voltage regulator is disabled by the compare circuit, the second voltage regulator may make available at its supply output up to a second predetermined current level at a regulated voltage. The second predetermined current level may be less than the first predetermined current level.

A method of operation of the regulator circuitry according to an exemplary embodiment of the present invention may include receiving a first supply voltage, comparing the first supply voltage to a predetermined voltage level, and selectively enabling a regulator circuit based upon the comparison, the regulator circuit making available to the circuit up to a first predetermined current level at a first regulated voltage at when enabled.

BRIEF DESCRIPTION OF THE DRAWINGS

A more complete understanding of the system and method of the present invention may be obtained by reference to the following Detailed Description when taken in conjunction with the accompanying Drawings wherein.

DETAILED DESCRIPTION OF THE EXEMPLARY EMBODIMENTS

The present invention will now be described more fully hereinafter with reference to the accompanying drawings in which exemplary embodiments of the invention are shown. This invention may, however, be embodied in many different forms and should not be construed as being limited to the embodiments set forth herein. Rather, the embodiments are provided so that this disclosure will be thorough and complete, and will fully convey the scope of the invention to those skilled in the art.

Figure 1:
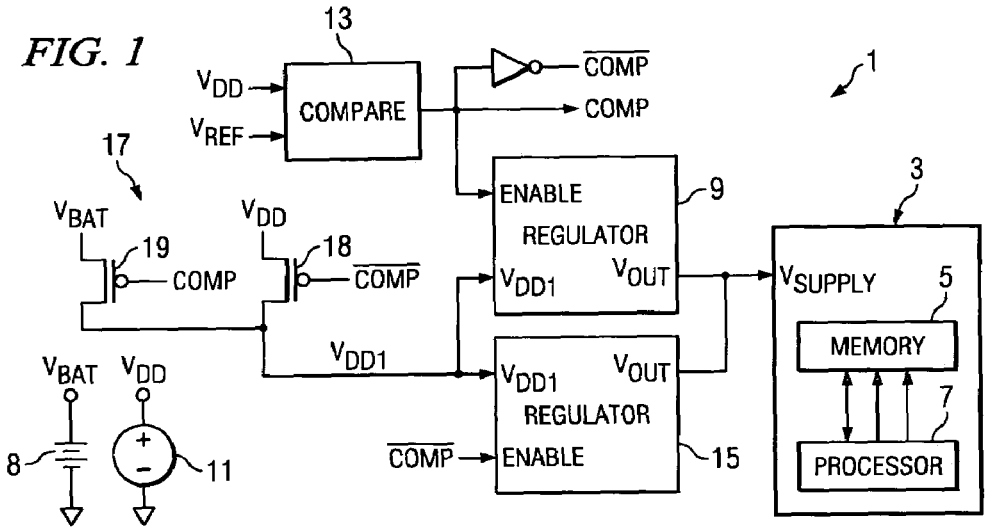
FIG. 1 is a block diagram of a system having regulator circuitry according to an exemplary embodiment of the present invention.

Referring to FIG. 1, there is shown an electronics system 1 having at least one circuit 3 that performs a plurality of predetermined operations. Circuit 3 may include, for example, a volatile memory 5. It is understood that circuit 3 may include other circuitry and perform other functions. For example, circuit 3 may include a processing element 7 coupled to memory 5 for processing information stored in memory 5. System 1 may be a computing device, a telecommunications device or some other electronics-based system.

According to an exemplary embodiment of the present invention, system 1 includes regulator circuitry for providing current to circuit 3 at one or more regulated voltages. System 1 may be a battery backed up system having a backup battery 8. System 1 may make available to circuit 3, during a normal mode of operation, a first predetermined current level at a first regulated voltage, and a second predetermined current level during a battery backup mode of operation. The second predetermined current level may be less than the first predetermined current level in order to reduce current drain on backup battery 8 and thereby extend the life thereof.

It is understood that instead of a backup battery 8, system 1 may have a different secondary power source.

The regulator circuitry of system 1 may include a first voltage regulator 9 that normally receives at a supply input thereof a first supply voltage from a first voltage supply 11 and is capable of providing from a supply output up to the first predetermined current level at a regulated voltage. The supply input of first voltage regulator 9 may be coupled to and be provided first voltage supply 11 during the normal mode of operation. The supply output of first voltage regulator 9 may be connected to the supply input of circuit 3. First voltage regulator 9 may include an enable input for receiving an enable signal. When the enable signal applied to the enable input of first regulator 9 is in an enable state, first voltage regulator 9 may make available from its supply output to circuit 3 up to the first predetermined current level at the regulated voltage that is based upon and stepped down from first voltage supply 11. When the enable signal applied to the enable input of first voltage regulator 9 is in a disable state, first voltage regulator 9 provides substantially no current to circuit 3. When first voltage regulator 9 is disabled, system 1 is adapted to provide to circuit 3 current from backup battery 8.

According to an exemplary embodiment of the present invention, the regulator circuitry of system 1 may include a second voltage regulator 15 having a supply input adapted to receive a supply voltage from a power supply and a supply output coupled to the supply input of circuit 3. Second voltage regulator 15 may further include an enable input for selectively enabling second voltage regulator 15. When enabled, second voltage regulator 15 may make available to circuit 3 a second predetermined current level at a regulated voltage that is based upon or stepped down from the voltage of backup battery 8. The second predetermined current level may be less than the first predetermined current level provided by first voltage regulator 9. When disabled, second voltage regulator 15 provides no current to circuit 3.

In order to switch between the normal mode of operation wherein first voltage regulator 9 provides current from first voltage supply 11 to circuit 3 at a regulated voltage, and the battery backup mode of operation wherein second voltage regulator 15 provides current circuit 3 from backup battery 8 at a regulated voltage level, system 1 may further include compare circuitry 13. Compare circuitry 13 may receive first voltage supply 11, compare the voltage of first voltage supply 11 to a predetermined voltage level and generate an output having a value based upon the comparison. Compare circuitry 13 may compare the voltage of first voltage supply 11 to the voltage of backup battery 8, but it is understood that compare circuitry 13 may compare the voltage of first voltage supply 11 to virtually any predetermined voltage level. The output of compare circuitry 13 may be coupled to the enable input of first voltage regulator 9. The output of compare circuitry 13 may also be coupled, via a logic inverter, to the enable input of second voltage regulator 15.

When enabled, second voltage regulator 15 may make available to circuit 3 the second predetermined current level at a regulated voltage that is less than the regulated voltage generated by first voltage regulator 9. It is understood, however, that second voltage regulator 15 may provide current at a regulated voltage that is the same regulated voltage generated by first voltage regulator 9.

System 1 may further include switching circuit 17 for providing the first voltage supply 11 and backup battery 8 to the first and second voltage regulators. Switching circuitry 17 may include a first transistor 18 coupled between first voltage supply 11 and the supply input of first voltage regulator 9 and second voltage regulator 15, and a second transistor 19 coupled between backup battery 8 and the supply input of first voltage regulator 9 and second voltage regulator 15. The control input of first transistor 18 may be coupled to the output of compare circuitry 13, via a logic inverter. Relatedly, the control input of second transistor 19 may be coupled to the output of compare circuitry 13. In this way, when the output of compare circuitry 13 is in the enable (logic high, in this example) state, the first transistor 18 is activated to provide to the first and second voltage regulators first voltage supply 11. When the output of compare circuitry 13 is in the disable (logic low) state, second transistor 19 is activated to provide to the first and second voltage regulators backup battery 8.

Figure 2:
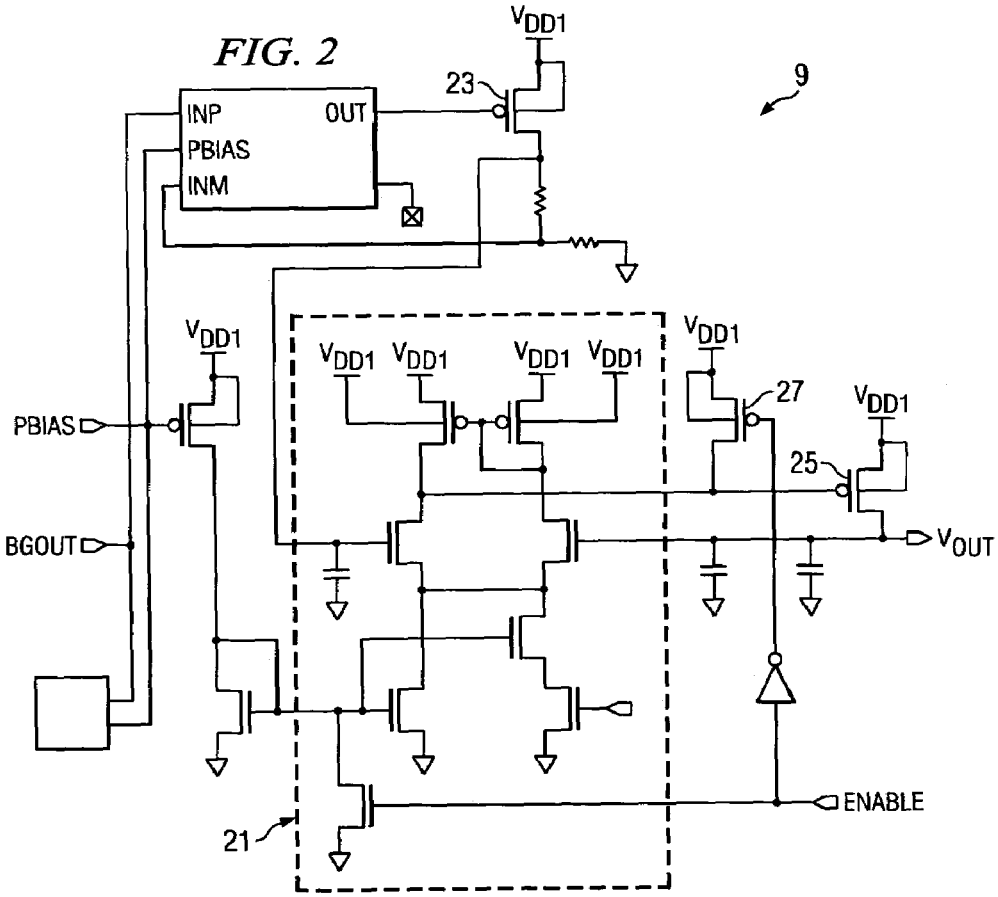
FIG. 2 is a schematic of a voltage regulator appearing in the system of FIG. 1.

FIG. 2 shows the circuit diagram of first voltage regulator 9 according to an exemplary embodiment of the present invention. First voltage regulator 9 may include differential amplifier circuitry 21 with suitable bias circuitry 23 that sources a predetermined current level. First transistor 25 may be coupled to differential amplifier circuitry 21 and be capable of conducting current that is proportional or otherwise related to the current level of differential amplifier circuitry 21. A first conduction terminal of first transistor 25 may be coupled to first transistor 18 and second transistor 19 (the receive the voltage source selected by switching circuitry 17), a second conduction terminal coupled to the output of first voltage regulator 9 and a control terminal coupled to an output of differential amplifier circuitry 21.

First transistor 25 is coupled to circuit 3 such that current flowing through first transistor 25 is capable of being sunk by circuit 3. Referring to FIG. 2, first transistor 25 is biased by the output of differential amplifier circuitry 21 at a voltage level to sufficiently turn on first transistor 25 so that the output voltage of first voltage regulator 9 is at the desired regulated voltage level. As a result, first transistor 25 performs in the saturation mode of operation. Because first transistor 25 is saturated, first transistor 25 may be considerably smaller than transistors utilized in unregulated systems operating in the linear mode of operation while still being capable of providing at least the minimum desired current level to circuit 3.

A second transistor 27 may be coupled to first transistor 25 and adapted to selectively activate first transistor 25 based upon the state of the output of compare circuitry 13. In particular, second transistor 27 may include a first conduction terminal coupled to the supply input of first voltage regulator 9, i.e., the one of first voltage supply 11 and backup battery 8 that is selected by switching circuitry 17 to source current to circuit 3, a second conduction terminal coupled to the control terminal of first transistor 25 and a control terminal coupled to the output of compare circuitry 13. When the output of compare circuitry 13 is in the disable (logic low) state, second transistor 27 is activated which serves to pull the control terminal of first transistor 25 to a logic high voltage level so as to deactivate first transistor 25. Conversely, when the output of compare circuitry 13 is in the enable (logic high) state, second transistor 27 is deactivated which allows first transistor 25 to be activated by differential amplifier circuitry 21 and capable of providing current to circuit 3.

Figure 3:
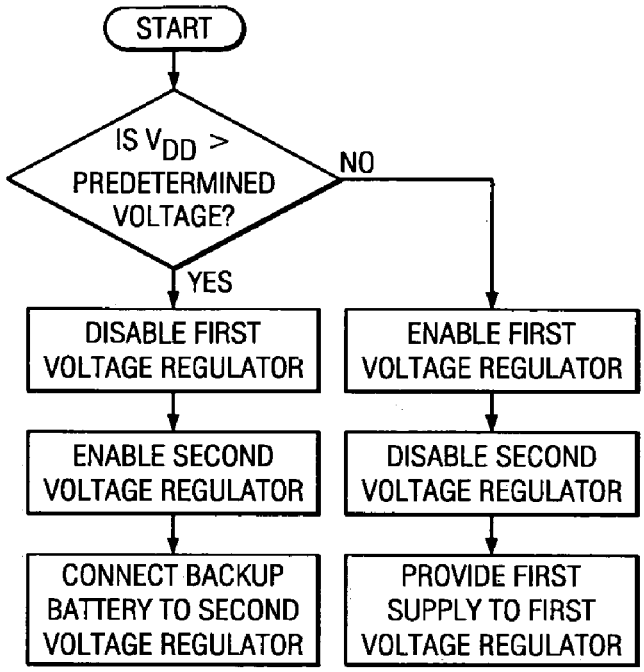
FIG. 3 is a flowchart illustrating an operation of the regulator circuitry of FIG. 1.

An operation of the voltage regulator circuitry of system 1 will be described with reference to FIG. 3. It is understood that the steps described below are not necessarily limited to the specific order presented in FIG. 3, and that the steps illustrated in FIG. 3 may have a different order. Initially, the voltage level of first voltage supply 11 is compared by the compare circuitry 13 to a predetermined voltage level. In the event the voltage of voltage supply 11 is greater than the predetermined voltage level, first voltage regulator 9 is enabled by compare circuitry 13 and second voltage regulator 15 is disabled. At around this same time, switching circuitry 17 couples to the second supply input of first voltage regulator 9 the first voltage supply 11. At this point, first voltage regulator 9 is capable of providing to circuit 3 up to the first predetermined current level at the regulated voltage level that is based upon the voltage of first voltage supply 11.

In the event the voltage of voltage supply 11 is not greater than the predetermined voltage level, first voltage regulator 9 is disabled and second voltage regulator 15 is enabled. At around this same time, switching circuitry 17 couples backup battery 8 to the supply input of first voltage regulator 9 and second voltage regulator 15. Backup battery 8 serves to activate second transistor 27 and thus disable first voltage regulator 9 so that no current is sourced thereby. At this point, second voltage regulator 15 is capable of providing to circuit 3 up to a second predetermined current, less than the first predetermined current, at a regulated voltage level that is based upon the voltage of backup battery 8.

Figure 4:
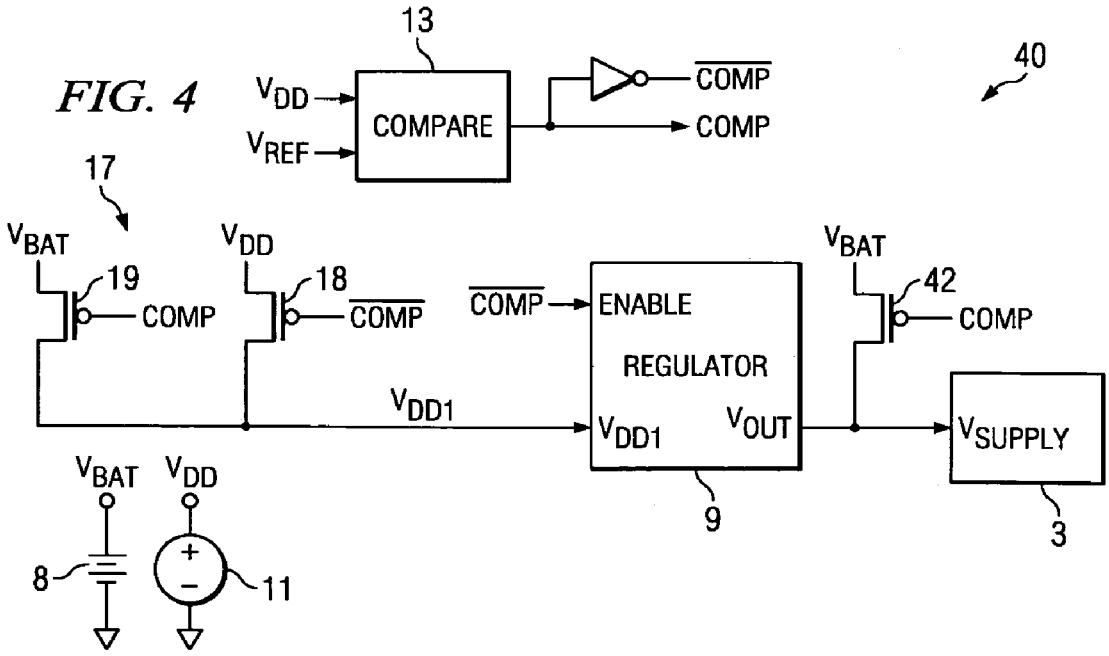
FIG. 4 is a block diagram of a system having regulator circuitry according to another exemplary embodiment of the present invention.

FIG. 4 illustrates a system 40 according to another exemplary embodiment of the present invention. System 40 includes regulator circuitry for selectively providing more than one power source to circuit 3. The regulator circuitry of system 40 does not include second voltage regulator 15. Instead, backup battery 8 is coupled to circuit 3 without having its voltage regulated. Specifically, backup battery 8 may be coupled to circuit 3 via a transistor 42. The control terminal of transistor 42 may be coupled to the output of compare circuitry 13. In the event the voltage of first voltage supply 11 is greater than the predetermined voltage level, compare circuitry 13 enables first voltage regulator 9 and deactivates transistor 42 to prevent backup battery 8 from being provided to circuit 13. Compare circuitry 13 also provides to the second supply input of first voltage regulator 9 first voltage supply 11. At this point, first voltage regulator circuit 9 provides up to a predetermined current level to circuit 3 at a regulated voltage level.

In the event the voltage of first voltage supply 11 is less than the predetermined voltage level, compare circuitry 13 disables first voltage regulator 9 and activates transistor 42 to provide backup battery 8 to circuit 13. Compare circuitry 13 also provides to the second supply input of first voltage regulator 9 backup battery 8. At this point, an unregulated backup battery 8 is provided to and sources circuit 3.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A system, comprising:

a first voltage regulator having a supply input coupled to a common unregulated supply voltage, an enable input and a first supply output, the first voltage regulator selectively providing at the first supply output up to a first predetermined current level at a regulated voltage based upon the common unregulated supply voltage;

compare circuitry having an input coupled to a first unregulated supply voltage and an output having a value indicative of whether the first unregulated supply voltage is greater than a predetermined voltage level;

a second voltage regulator having a supply input coupled to the common unregulated supply voltage, an enable input responsive to the compare circuitry output and a second supply output, the second voltage regulator selectively providing at the second supply output thereof up to a second predetermined current level at a regulated voltage based upon the common unregulated supply voltage, the first supply output of the first voltage regulator being coupled to the second supply output of the second voltage regulator; and switching circuitry operable responsive to the output of the compare circuitry for applying either the first unregulated supply voltage or a second unregulated supply voltage as the common unregulated supply voltage.

2. The system of claim 1, wherein the supply input of the first voltage regulator is coupled to the supply input of the second voltage regulator.

3. The system of claim 1, wherein the first unregulated voltage is sourced from an external power supply.

4. The system of claim 3, wherein the second unregulated voltage is sourced from a battery.

5. The system of claim 1, wherein the regulated voltage provided by the second voltage regulator is less than the regulated voltage provided by the first voltage regulator.

6. The system of claim 1, wherein the first voltage regulator comprises a first transistor having a first conduction terminal coupled to the supply input thereof, a second conduction terminal coupled to the first supply output of the first voltage regulator and a control terminal, the transistor providing to the first supply output of the first voltage regulator the first predetermined current level.

7. The system of claim 6, further comprising biasing circuitry coupled to a control terminal of the first transistor, wherein the first transistor operates in a saturation mode of operation when enabled.

8. The system of claim 1, wherein the switching circuitry comprises a transistor having a first conduction terminal coupled to one of the first/second unregulated supply voltages, a second conduction terminal coupled to the supply input of the first voltage regulator and a control terminal coupled to the output of the compare circuitry.

9. The system of claim 1, further comprising a volatile memory coupled to the first supply output.

10. A system, comprising:

a first voltage regulator having a supply input coupled to a first supply voltage, an enable input and a supply output, the first voltage regulator selectively providing at the supply output up to a first predetermined current level at a regulated voltage based upon the first supply voltage when enabled and providing substantially no current when disabled;

compare circuitry having an input coupled to the first supply voltage and an output coupled to the enable input of the first voltage regulator and having a value indicative of whether the first supply voltage is greater than a predetermined voltage level; and circuitry having a supply input coupled to the supply output of the first voltage regulator, wherein the first voltage regulator comprises a first transistor having a first conduction terminal coupled to the supply input of the first voltage regulator, a second conduction terminal coupled to the supply output of the first voltage regulator and a control terminal, the transistor providing to the supply output of the first voltage regulator the first predetermined current level, and wherein the first voltage regulator further comprises a second transistor having a first conduction terminal coupled to the supply input of the first voltage regulator, a control terminal coupled to the output of the compare circuitry and a second conduction terminal coupled to the control terminal of the first transistor.

11. A device, comprising:

a first voltage regulator having a supply input, an enable input and a supply output, the first voltage regulator receiving a common unregulated supply voltage at the supply input and providing at the supply output a regulated voltage at up to a first predetermined current level when enabled and providing substantially no current when disabled, a switching circuit for applying either a first unregulated supply voltage or a second unregulated supply voltage as the common unregulated supply voltage, and a compare circuit having an input adapted to be coupled to the first unregulated supply voltage, for generating a signal at an output of the compare circuit having a value indicative of the first unregulated supply voltage appearing at the input being greater than a predetermined reference voltage, the output of the compare circuit being coupled to the enable input of the first voltage regulator and to control the operation of the switching circuit.

12. The device of claim 11, wherein the first regulator comprises a first transistor having a first conduction terminal coupled to the supply input thereof, a second conduction terminal coupled to the supply output of the first voltage regulator and a control terminal, the transistor providing to the supply output of the first voltage regulator up to the first predetermined current level.

13. The device of claim 12, further comprising biasing circuitry coupled to the control terminal of the first transistor for providing a predetermined biased voltage thereto, wherein the first transistor operates in a saturation mode of operation when activated.

14. The device of claim 11, further comprising a second voltage regulator having a supply input, an enable input and a supply output, the second voltage regulator receiving the common unregulated supply voltage at the supply input and providing at the supply output thereof a regulated voltage at up to a second predetermined current level when enabled, the supply output of the first voltage regulator being coupled to the supply output of the second voltage regulator.

15. The device of claim 14, wherein the supply input of the first voltage regulator is coupled to the supply input of the second voltage regulator.

16. The device of claim 14, wherein the first unregulated supply voltage is provided to the switching circuit from an external power supply.

17. The device of claim 14, wherein the first unregulated supply voltage is provided to the switching circuit from an external power supply and second unregulated supply voltage is provided to the switching circuit from a battery.

18. The device of claim 14, wherein the regulated voltage provided by the second voltage regulator is less than the regulated voltage provided by the first voltage regulator.

19. The device of claim 14, further comprising a compare circuit having an input adapted to be coupled to the first unregulated supply voltage, for generating a signal at an output of the compare circuit having a value indicative of the first unregulated supply voltage appearing at the input being greater than a predetermined reference voltage, the output of the compare circuit being coupled to the enable inputs of the first and second voltage regulators so alternately enable the regulators and further coupled to control the operation of the switching circuit to alternately select the first and second unregulated supply voltages as the common unregulated supply voltage.

20. The device of claim 11, further comprising a transistor having a first conduction terminal coupled adapted to be coupled to a battery, a second conduction terminal coupled to the output of the first voltage regulator and a control terminal coupled to the output of the compare circuit.

21. A device, comprising:

a first voltage regulator having a supply input, an enable input and a supply output, the first voltage regulator receiving a supply voltage at the supply input and providing at the supply output a regulated voltage at up to a first predetermined current level when enabled and providing substantially no current when disabled, wherein the first regulator comprises a first transistor having a first conduction terminal coupled to the supply input thereof, a second conduction terminal coupled to the supply output of the first voltage regulator and a control terminal, the transistor providing to the supply output of the first voltage regulator up to the first predetermined current level, and wherein the first voltage regulator further comprises a second transistor having a first conduction terminal coupled to the supply input of the first voltage regulator, a control terminal coupled to the enable input and a second conduction terminal coupled to the control terminal of the first transistor.

* * * * *